US007918538B2

(12) United States Patent
Sakurai

(10) Patent No.: US 7,918,538 B2
(45) Date of Patent: Apr. 5, 2011

(54) PRINTHEAD FORMED OF ELEMENT SUBSTRATES HAVING FUNCTION CIRCUITS

(75) Inventor: Masataka Sakurai, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 713 days.

(21) Appl. No.: 11/953,555

(22) Filed: Dec. 10, 2007

(65) Prior Publication Data

US 2008/0303868 A1 Dec. 11, 2008

(30) Foreign Application Priority Data

Dec. 12, 2006 (JP) ..... 2006-335069

(51) Int. Cl.
*B41J 2/05* (2006.01)

(52) U.S. Cl. ..... 347/57; 347/58

(58) Field of Classification Search ..... 347/5, 9, 347/12, 17–18, 56–59, 49–50, 40, 42–43
See application file for complete search history.

(56) References Cited

U.S. PATENT DOCUMENTS

| | | | | |
|---|---|---|---|---|
| 6,027,198 | A * | 2/2000 | Tanaka et al. | 347/12 |
| 6,290,334 | B1 | 9/2001 | Ishinaga et al. | |
| 6,302,504 | B1 | 10/2001 | Imanaka et al. | |
| 6,945,622 | B2 | 9/2005 | Sakurai | |
| 2005/0134620 | A1 | 6/2005 | Hirayama et al. | |
| 2006/0284909 | A1 | 12/2006 | Kasai et al. | |

* cited by examiner

*Primary Examiner* — Juanita D Stephens
(74) *Attorney, Agent, or Firm* — Fitzpatrick, Cella, Harper & Scinto

(57) ABSTRACT

In a printhead having a plurality of element substrates, the effects of the rise in element substrate temperature and current noise are not manifested in a biased manner in only one of the element substrates. The printhead includes a plurality of printing elements and is provided with first and second element substrates having the plurality of printing elements and a second element substrate in such a manner that the first element substrate and second element substrate are spaced apart, with the first element substrate having a first function circuit electrically connected to the second element substrate and having processing functions used for driving the printing elements of the second element substrate.

12 Claims, 15 Drawing Sheets

PRINTHEAD FORMED OF ELEMENT SUBSTRATES HAVING FUNCTION CIRCUITS

BACKGROUND OF THE INVENTION

1. Field of the Invention

The present invention specifically relates to an inkjet printhead having printing elements used for generating energy for discharging ink and driving circuits used for driving the printing elements formed on the same element substrate, as well as to a head cartridge and a printing apparatus utilizing the printhead.

2. Description of the Related Art

Generally speaking, the printing elements of a printhead installed in an inkjet printing apparatus, i.e. electrothermal transducers (heaters), as well as their driving circuits, are formed on the same substrate using semiconductor processing techniques as described, for example, in U.S. Pat. No. 6,290,334.

In recent inkjet printing apparatuses, there has been a tendency to provide a printhead with multiple nozzle arrays corresponding to inks of multiple colors for the purpose of improving, for example, the level of print quality and the speed of printing.

As an example of implementing such multiple nozzle arrays corresponding to inks of multiple colors, configurations exist, in which an element substrate used for discharging black ink for the purpose of printing text, etc., and an element substrate used for discharging color inks for the purpose of printing photographs, diagrams, and tables, etc., are installed in a single printhead.

Moreover, as another example, configurations exist, in which multiple element substrates are installed in order to implement printing in inks of multiple colors, such as 6 colors or 8 colors, for the purpose of improving the tonal characteristics and expanding the color space of the printed images.

The installation of multiple element substrates for the purpose of improving the level of print quality and the speed of printing is proposed as a characteristic feature of these recent printheads.

Element substrates with integrally formed heaters and driving circuits have various layouts. As an example, FIG. 4 shows an element substrate, in which pads of power supply terminals connected to the outside and signal terminals are disposed along the short sides of the element substrate and, from there, are connected to internal circuits through aluminum (Al) wiring.

Logic signals, such as supply voltage, image data, etc., are input from the pads 410 disposed along the short sides of the element substrate 400. As necessary, the input signals etc. are input to shift registers 403 through input circuits 402. The shift registers 403 convert the input serial data into parallel data. Image data, as part of the data converted into parallel data, is output to printing element (heater) selection circuit arrays 405, while the other portion of the data is output to decoders 404 as time-division data. In the decoders 404, time-division signals defining the timing used for driving the heaters are output to the printing element selection circuit arrays 405 including AND circuits and the like. The printing element selection circuit arrays 405 select the heaters to be turned on from among the heaters contained in heater arrays 407. The driver transistors of driver transistor arrays 406 corresponding to the selected heaters drive the respective heaters by supplying them with electric current, thereby resulting in the generation of a bubble and discharge of the ink.

Moreover, function circuits 105 are circuits having processing functionality used to provide more efficient drive control for the heaters. Examples of the function circuits 105 include circuits generating or converting the driver driving voltage used to drive the driver transistors, circuits generating a voltage used as a reference, circuits controlling a drive current fed to the heaters, circuits externally outputting information on the element substrate 400, such as temperature etc., memory units used to hold and store information on the element substrate 400, circuits used for processing and modifying various data, etc. Thus, the term "function circuits" refers not only to circuits used to transfer data and signals to various element substrates, but also to circuits performing processing functions, such as voltage generation and conversion, data processing and modification, data storage and output, etc.

It should be noted that while FIG. 4 shows an embodiment, in which the element substrate 400 has an ink supply port 104, there are abundantly available embodiments, in which a plurality of ink supply ports 104 are disposed on a single element substrate, permitting discharge of inks of multiple colors. Furthermore, printheads have been widely adopted that combine an element substrate used for discharging black ink (black ink element substrate), which has one ink supply port 104, and an element substrate used for discharging color inks (color ink element substrate), which has multiple ink supply ports 104.

Typically, in an element substrate 400 provided with multiple ink supply ports 104, there are disposed multiple printing element selection circuits and circuits used for drive control corresponding to the number of the ink supply ports 104. In addition, in such a case, the configuration of the circuits is implemented in an efficient manner suitable e.g. for sharing the circuits that can be shared within the element substrate 400.

In addition, there are printheads, in which NMOS transistor-based power transistors are utilized as driver transistors used to supply electric current to the heaters. A printhead configuration, in which the supply voltage (e.g. 3.3V or 5V, etc.) of a logic circuit is boosted and applied to the gates of NMOS transistors in order to improve the drivability of the NMOS transistors, has been disclosed in U.S. Pat. No. 6,302,504.

FIG. 6 is a diagram illustrating a conventional example showing an equivalent circuit of a single segment comprising one heater, one driver transistor, etc. It should be noted that while the converted voltage generation unit, as shown in FIG. 7, is provided so as to be common to multiple segments, the purpose of the description herein is to show connections, and therefore it is not provided for each single heater.

A heater-driving signal is output from a heater selection circuit 120 at a voltage equal to the supply voltage VDD of the logic circuit via a shift register (S/R), a decoder, etc., which are not shown in the figure. In a level converter 121, the heater-driving signal is boosted to a driver driving voltage VHTM, which is higher than the supply voltage VDD of the logic circuit, after which the signal is input to the gate of a driver transistor 123 through a driver driving buffer 122. This is done in order to reduce the effective resistance in the driver transistor 123 during the operation of the heater 124 by applying a voltage that is higher than the supply voltage of the logic circuit to the gate of the driver transistor 123. It should be noted that the driver driving voltage VHTM is generated by a converted voltage generation unit 125 located within the element substrate from a voltage VHT having the same potential as the heater supply voltage VH input from the printer main body.

FIG. 7 is a diagram illustrating a relationship between a converted voltage generation unit and driving circuits used for multiple segments provided on an element substrate in a printhead.

As shown in FIG. 7, each of the M segments is provided with a level converter, a driver driving buffer, and a driver transistor 123, with signals from the above-described heater selection circuit input to each of the segments. Moreover, the element substrate is provided with at least one converted voltage generation unit 125 that inputs, to each of the segments, the driver driving voltage VHTM generated from the voltage VHT having the same potential as the heater supply voltage VH.

FIG. 8 shows a circuit diagram of a converted voltage generation circuit.

The converted voltage generation circuit of FIG. 8 (converted voltage generation unit 125) is configured such that the driver driving voltage VHTM is output by a source follower circuit that applies the desired voltage, which is set depending on the resistance ratio of resistors 130 and 131, to the gate of a MOS transistor 132. The voltage value of the driver driving voltage VHTM is determined by the ratio of the resistance values of the resistors 130,131 and voltage VHT, which has the same potential as the heater supply voltage VH.

In general, inkjet printheads have been regularly modified to increase the number of nozzles and their density in order to raise the speed of printing and enhance the quality level of the printed images. However, for example, in thermal inkjet printers, in which the discharge of ink is carried out by generating heat with the help of heaters, the temperature of the element substrate rises because the heaters are caused to generate energy required for discharging the ink. Since the rise in the temperature of the element substrate affects the generation of a bubble and discharge characteristics of the ink, it becomes necessary to adjust the energy applied to the heaters while monitoring the temperature of the element substrate. However, in some cases, when the temperature of the element substrate becomes higher than the temperature, at which the energy imparted to the ink can be regulated, the printing operation may have to be temporarily suspended to allow the element substrate to naturally cool.

The effects of the rise in element substrate temperature tend to be particularly pronounced in element substrates used for color inks, where the droplets of the discharged inks have to be made smaller in order to implement a high level of quality during photographic image printing.

In addition, the feature whereby ink discharge is carried out by heating with heaters requires an electric current of several tens to several hundred mA to flow through each heater. For this reason, as the number of nozzles that simultaneously discharge ink increases, concern arises that the current noise caused by the current flowing to these heaters may affect the operation of the function circuits provided on the element substrate.

Moreover, there are cases, for instance, such as when photographic images are printed, in which the black ink element substrate is practically inactive and the operation of the color ink element substrate takes center stage. On the other hand, there are cases, such as when text images are printed, in which the color ink element substrate is practically inactive and the operation of the black ink element substrate takes center stage. Thus, there are cases, in which the used element substrate is just one of the substrates. On the other hand, due to the fact that printheads having conventional separate black and color element substrates had function circuits provided for each one of the element substrates in order to impart various functions to the element substrates, circuit operation also tended to concentrate on a single element substrate. For this reason, the effects of the current noise and the rise in element substrate temperature were sometimes manifested in a biased manner in only one of the element substrates.

SUMMARY OF THE INVENTION

The present invention is directed to a printhead, a head cartridge, and a printing apparatus.

It is an object of the present invention to provide a printhead having multiple element substrates, in which the effects of the rise in element substrate temperature and current noise are reduced by optimizing the arrangement of the function circuits.

According to one aspect of the present invention, preferably, there is provided a printhead comprising a plurality of printing elements and provided with first and second element substrates having the plurality of printing elements in such a manner that the first element substrate and second element substrate are spaced apart, wherein the first element substrate has a first function circuit electrically connected to the second element substrate and having processing functions used for driving the printing elements of the second element substrate.

According to another aspect of the present invention, preferably, there is provided a head cartridge having an ink tank containing ink and a printhead comprising a plurality of printing elements and provided with first and second element substrates having the plurality of printing elements in such a manner that the first element substrate and second element substrate are spaced apart, wherein the first element substrate has a first function circuit electrically connected to the second element substrate and having processing functions used for driving the printing elements of the second element substrate.

According to still another aspect of the present invention, preferably, there is provided a printing apparatus having a printhead comprising a plurality of printing elements and provided with first and second element substrates having the plurality of printing elements in such a manner that the first element substrate and second element substrate are spaced apart, wherein the first element substrate has a first function circuit electrically connected to the second element substrate and having processing functions used for driving the printing elements of the second element substrate.

The invention is particularly advantageous because it can provide a printhead having multiple element substrates, as well as a head cartridge and a printing apparatus, in which the effects of the rise in element substrate temperature and current noise are reduced by optimizing the arrangement of the function circuits.

Further features of the present invention will become apparent from the following description of exemplary embodiments (with reference to the attached drawings).

DESCRIPTION OF THE EMBODIMENTS

Figure 1:
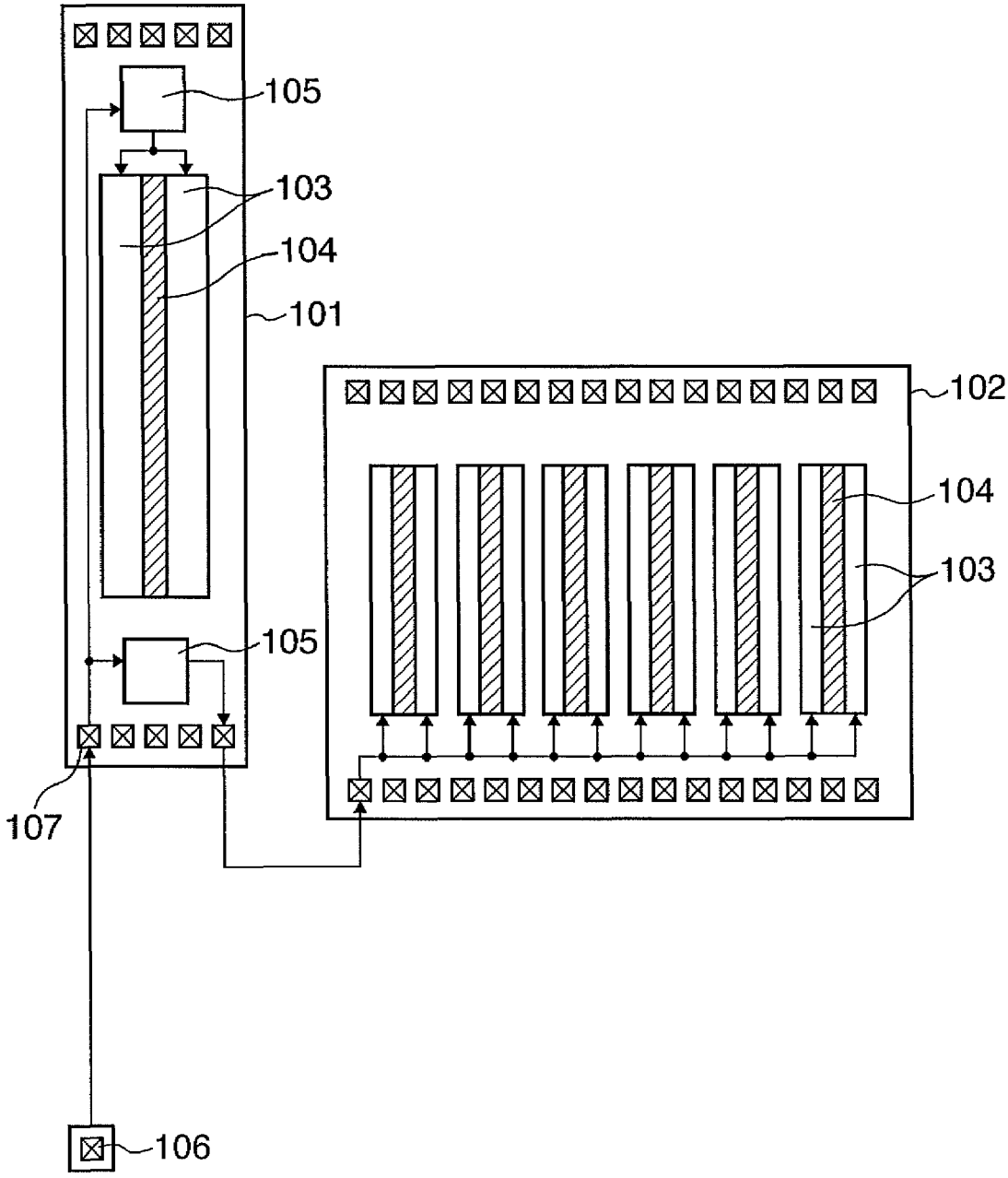
FIG. 1 is a block diagram illustrating the circuit configuration of the first embodiment.

In accordance with the present invention, in a printhead having multiple element substrates, function circuits are disposed between the multiple element substrates in a distributed fashion; otherwise, the function circuits are moved to, and placed on, other element substrates. This makes it possible to mitigate the effects of the temperature rise due to the operation of the heaters, the effects of the power consumption by said function circuits on the ink discharge characteristics, the effects of the current noise on the function circuits, etc. and to design an optimized printhead. In other words, the effects of temperature and noise can be suppressed by allowing circuits disposed on one element substrate to be used by another element substrate.

For instance, when the temperature of the element substrate rises as a result of power consumption by the function circuits and the temperature rise affects the generation of a bubble and discharge characteristics of the ink, heat generated by power consumption is distributed between multiple element substrates, thereby permitting attenuation of its effects on the generation of a bubble and discharge characteristics of the ink.

Recent inkjet printers produce color ink droplets of small size in order to raise the level of print quality when printing photographic images etc. The smaller the droplets, the greater the influence exerted on the level of print quality by changes in droplet size occurring due to changes in element substrate temperature. On the other hand, in comparison with the size of color ink droplets, the size of black ink droplets used when printing text, etc. is larger and in this case changes in droplet size occurring due to changes in element substrate temperature can hardly present serious problems.

Thus, for instance, some function circuits used for discharging color inks can be provided on the black ink element substrate in order to reduce changes in the temperature of the color ink element substrate due to the operation of the function circuits used for the discharging of the color inks, thereby producing the effect of raising the level of print quality of the color images. On the other hand, since changes in the temperature of the black ink element substrate are relatively problem-free in comparison with changes in the temperature of the color ink element substrate, it becomes possible to optimize the design of the head as a whole.

Moreover, there are other configurations, wherein the function circuits are used in a complementary manner between the color ink element substrate and black ink element substrate. In a printhead having a color ink element substrate installed for the primary purpose of printing photographs, diagrams, tables, etc. and a black ink element substrate installed for the primary purpose of printing text and the like, the function circuits of the black ink element substrate are operated in color printing mode and their functions are used by the color ink element substrate. In doing so, it becomes possible to avoid effects of the temperature rise due to the operation of the function circuits on the generating an ink bubble and discharge characteristics of the color ink element substrate. Moreover, the function circuits mounted on the color ink element substrate can be operated during the operation of the black ink element substrate to prevent the generating an ink bubble and discharge characteristics of the black ink element substrate from being affected.

Such operation is made possible by the fact that ink discharge from the color ink element substrate takes center stage and the heaters of the black ink element substrate are practically inactive during the printing of photographs, diagrams, and tables. Moreover, it is made possible by the fact that ink discharge from the black ink element substrate takes center stage and the heaters of the color ink element substrate are practically inactive during the printing of text and the like.

Although the example described herein involves a black ink element substrate and a color ink element substrate, there may be cases in which there are, for instance, multiple black ink element substrates.

Moreover, operating the function circuits of the substrate having little electric current used for driving heaters flowing therethrough permits a reduction in the rise in element substrate temperature and a reduction in the effects of the current noise due to the electric current flowing through the heaters, thereby permitting safe operation of the function circuits. These effects are particularly pronounced when analog circuits are used as the function circuits.

Moreover, if a function circuit with a BiCMOS structure having bipolar transistors and CMOS transistors is required, a printhead configuration can be used, in which a function circuit with a BiCMOS structure is provided on a single element substrate and this function circuit is utilized by multiple element substrates. In addition, by providing other element substrates with function circuits with CMOS or other structures that are cheaper than BiCMOS, the total cost of the printhead can be suppressed and high-level functionality can be implemented.

Moreover, the arrangement of circuits and other devices on the element substrates can usually be made more compact by placing devices performing similar functions in close proximity. For instance, efficient integration is made possible by placing devices of the same type in array form and reducing their arrangement spacing or placing control terminals and power supply terminals required by the function circuits in proximity to one another. In the past, identical function circuits were separately provided for each one of the multiple element substrates. In the present invention, costs can be suppressed by placing function circuits used by other element substrates on a single element substrate so as to reduce the overall area in the multiple element substrates that the printhead has.

As described above, the present invention makes it possible to mitigate the effects of the rise in element substrate temperature on the discharge characteristics, mitigate the effects of the current noise on the function circuits, and mitigate the total cost of the printhead.

Below, preferred embodiments of the present invention will be described in detail with reference to the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "link" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

It should be noted that, as used in the descriptions, the term "element substrate" does not refer simply to a substrate composed of silicon semiconductor, but refers to a substrate, on which elements, wiring, etc. have been provided.

The expression "on an element substrate" means not only "on the surface of an element substrate", but also means "inside an element substrate, on the surface, or in the vicinity of the surface, of the element substrate". Moreover, the term "built-in", as used in the present invention, is not a word that refers simply to the arrangement of separate elements on a substrate, but one that refers to forming and fabricating elements integrally with an element substrate using semiconductor circuit fabrication processes etc.

<Description of Inkjet Printing Apparatus (FIG. 5)>

Figure 5:
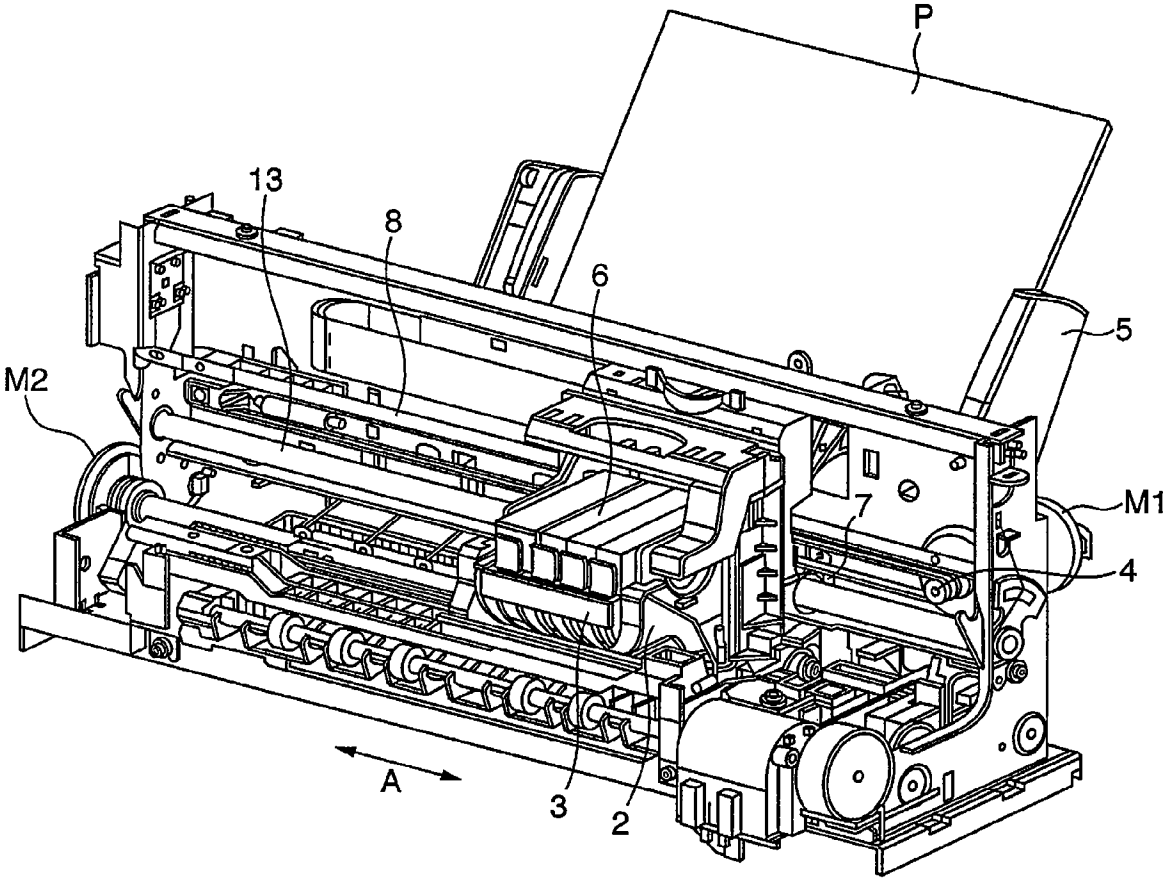
FIG. 5 is an external perspective view showing a general configuration of an inkjet printing apparatus according to a representative embodiment of the present invention.

FIG. 5 is an external perspective view showing the general configuration of an inkjet printing apparatus according to a representative embodiment of the present invention.

As shown in FIG. 5, the inkjet printing apparatus (hereinafter referred to as "printing apparatus") has installed therein a printhead 3, which carries out printing by discharging ink based on inkjet technology. Drive generated by a carriage motor M1 is transmitted by a transmission mechanism 4 to a carriage 2, on which the printhead 3 is installed. Simultaneously with its reciprocal travel, printing is carried out by feeding a print medium P, e.g. print paper, through a paper-feed mechanism 5, conveying it to a print location, and discharging ink onto the print medium P from the printhead 3 at the print location.

Not only is the printhead 3 installed on the carriage 2 of the printing apparatus, but ink tanks 6 containing ink supplied to the printhead 3 are mounted on it as well. The ink tanks 6 are detachable from the carriage 2.

The printing apparatus 1 depicted in FIG. 5 is capable of color printing, which is why four ink tanks containing, respectively, magenta (M), cyan (C), yellow (Y), and black (K) ink are installed on the carriage 2. These four ink tanks are detachable independently of one another.

Now, the carriage 2 and printhead 3 have the abutment surfaces of the two members brought in proper contact so as to be able to achieve and maintain the desired electrical connection. The printhead 3 prints by selectively discharging ink from multiple orifices as a result of energy application in response to print signals. The printhead 3 of this embodiment, in particular, is based on inkjet technology, in which ink is discharged with the help of heat energy, and is equipped with electrothermal transducers for generating the heat energy. Electrical energy applied to the electrothermal transducers is converted to heat energy and ink is discharged from the orifices as a result of pressure changes generated by the growth and collapse of air bubbles due to film boiling produced when the heat energy is imparted to the ink. The electrothermal transducers are provided respectively at each one of the orifices, with ink discharged from the corresponding orifice when a pulse voltage is applied to the corresponding electrothermal transducer in response to a print signal.

As shown in FIG. 5, the carriage 2 is connected to a portion of a drive belt 7 of the transmission mechanism 4 transmitting the drive of the carriage motor M1 and is slidingly supported and guided in the direction of arrow A along a guide shaft 13. Accordingly, the carriage 2 reciprocates along the guide shaft 13 depending on the forward and reverse rotation of the carriage motor M1. Moreover, there is provided a measuring scale 8, which is used to indicate the position of the carriage 2 in the direction of travel of the carriage 2 (direction of arrow A).

Moreover, in the printing apparatus, there is a provided a platen (not shown) facing the orifice surface of the printhead 3, on which the orifices (not shown) are formed, and the carriage 2, on which the printhead 3 is installed, is reciprocated by the drive of the carriage motor M1. At the same time, printing is carried out across the entire width of the print medium P conveyed onto the platen by supplying print signals to the printhead 3 and discharging ink.

<Control Configuration of Inkjet Printing Apparatus (FIG. 9)>

Figure 9:
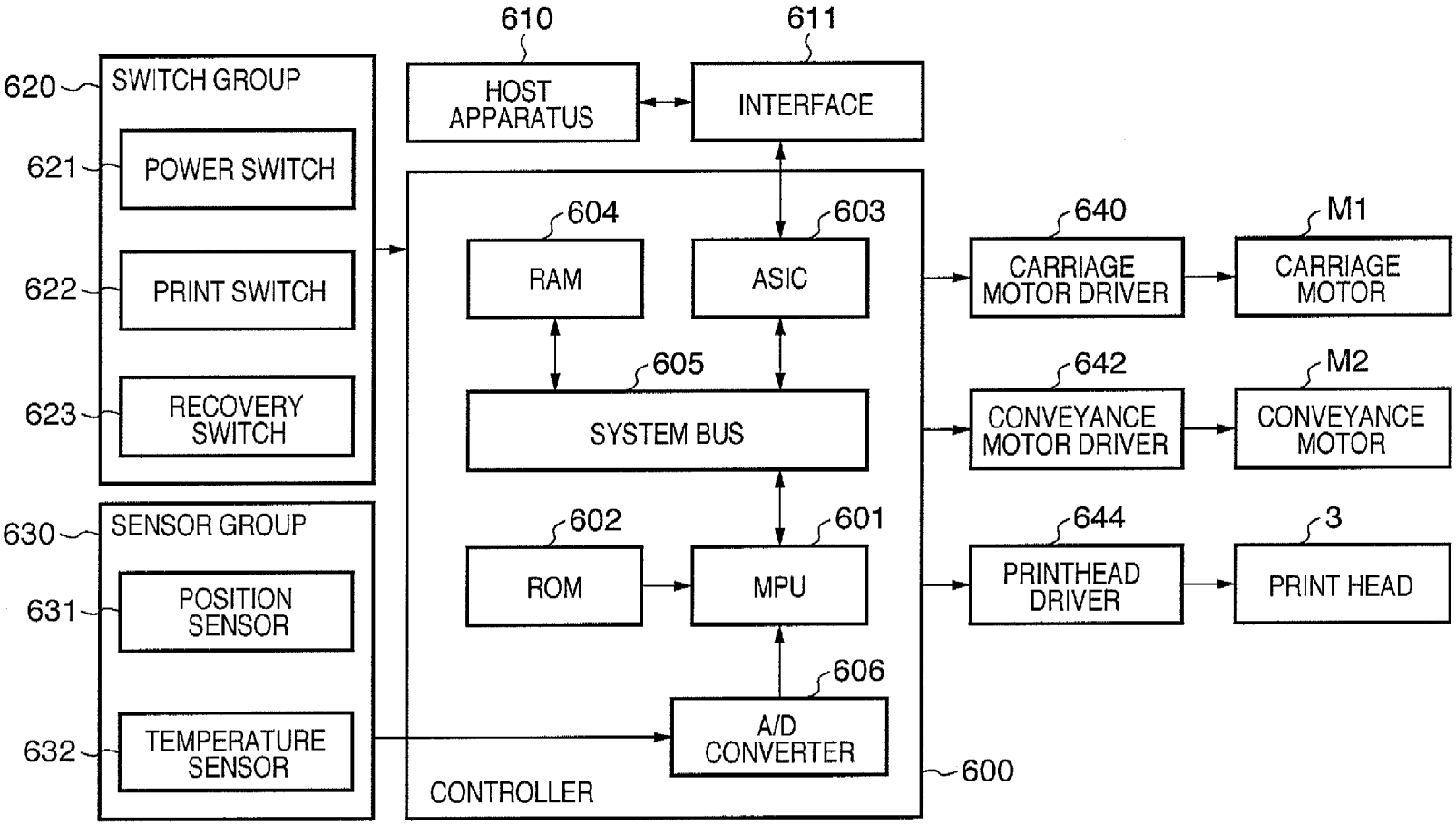
FIG. 9 is a block diagram illustrating the configuration of a control circuit in a printing apparatus.

FIG. 9 is a block diagram illustrating the control configuration of the printing apparatus illustrated in FIG. 5.

As shown in FIG. 9, a controller 600 has an MPU 601 and a ROM 602, which stores a program corresponding to a control sequence, which is described below, the necessary tables, and other fixed data. Moreover, it has an application-specific integrated circuit (ASIC) 603, which generates control signals used for controlling the carriage motor M1, controlling the conveyance motor M2, and controlling the printhead 3. Moreover, it has a RAM 604 provided with a space for image data expansion, a workspace for program execution, etc. In addition, it has a system bus 605, which performs data interchange by interconnecting the MPU 601, ASIC 603, and RAM 604. Furthermore, it has an A/D converter 606, which accepts analog signals from a hereinafter described sensor group as input, subjects them to A/D conversion, and supplies the digital signals to the MPU 601.

In addition, 610 in FIG. 9 is a computer etc., which serves as an image data supply source and is generically called a host apparatus. Image data, commands, status signals, etc. are sent and received between the host apparatus 610 and printer apparatus through an interface (I/F) 611.

Furthermore, 620 is a switch group made up of switches used for receiving command input from an operator, such as a power switch 621, a print switch 622 used for issuing commands to begin printing, a recovery switch 623 used to issue instructions to start recovery processing, etc. 630 is a sensor group made up of a position sensor 631, such as a photo-coupler, a temperature sensor 632, etc.

Furthermore, 640 is a carriage motor driver used for driving the carriage motor M1 and 642 is a conveyance motor driver used for driving the conveyance motor M2. In addition, 644 is a printhead driver used for driving the printhead 3.

It should be noted that while the configuration illustrated in FIG. 5 permits separation of the ink tank 6 and printhead 3, it is also possible to use a replaceable head cartridge, in which these components are integrally formed.

Figure 10:
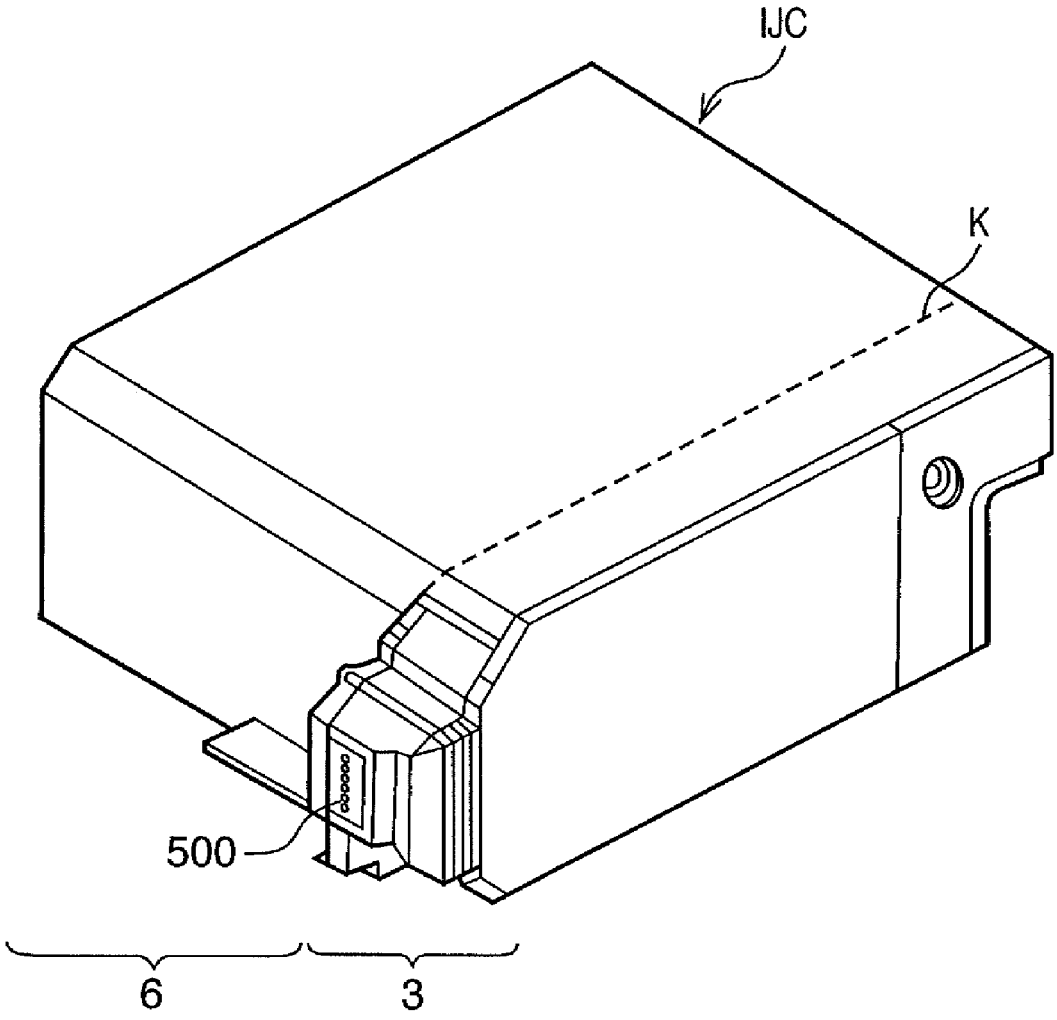
FIG. 10 is an external perspective view showing the configuration of a head cartridge having an ink tank and a printhead integrally formed therein.

FIG. 10 is an external perspective view illustrating the configuration of a head cartridge IJC having an ink tank and a printhead integrally formed therein. In FIG. 10, the dotted line K is a boundary between the ink tank 6 and the printhead 3. The head cartridge IJC is provided with electrodes (not shown) used to receive electrical signals, which are supplied from the carriage 2 when it is installed in the carriage 2. The printhead 3 is then actuated and ink is discharged in accordance with the electrical signals.

It should be noted that, in FIG. 10, 500 is an ink orifice array.

The First Embodiment

The first embodiment shows an example, in which function circuits used to drive a color ink element substrate are installed on a black ink element substrate. In the present embodiment, providing function circuits on the black ink element substrate, which is not easily affected by heat generated in the element substrate as a result of power consumption by the function circuits during ink discharge, mitigates the rise in the temperature of the color ink element substrate, which is easily affected, and makes it possible to achieve high-quality color printing.

FIG. 1 is a block diagram illustrating the circuit configuration of the first embodiment.

101 denotes an element substrate (black ink element substrate), which discharges relatively large droplets of black ink mainly for the purpose of text printing etc. 102 denotes an element substrate (color ink element substrate), which discharges relatively small ink droplets mainly for the purpose of printing color images, such as photographs etc. These two element substrates are provided on the same printhead. Here, descriptions will be provided regarding the arrangement of the function element circuits on the black ink element substrate and color ink element substrate. However, alternatively, the descriptions may also apply to the arrangement of function element circuits on element substrates of the same color but with different amounts of discharged ink or element substrates of the same color and same amounts of discharged ink.

Ink supply ports 104, which are used to supply ink to the element substrates, are formed on the black ink element substrate 101, on which there is a single port, and on the color ink element substrate 102, on which there are six ports. Arrays 103, which are made up of heaters and their driving circuits, as well as control circuits, are disposed on both sides of the ink supply ports 104. The ink supply port 104 of the black ink element substrate is an ink supply port used for supplying black ink to the nozzles. The ink supply ports 104 of the color ink element substrate are ink supply ports used for supplying yellow, magenta, cyan, photographic black ink, etc.

Electrical connection is provided through wiring from head pads 106 to pads 107 on the element substrate, with the head pads providing electrical connection between the printhead and the main body of the printing apparatus. For simplicity, FIG. 1 schematically shows only a head pad 106 associated with the hereinafter described function circuits 105, which constitute a characteristic feature of the present invention. For this reason, other head pads 106, as well as the electrical connections between the head pads 106 and pads 107 on the element substrate, are omitted. Here, two function circuits 105, which are converted voltage generation circuits generating voltage applied to the driving circuits, are installed on the black ink element substrate, with the functions of the two function circuits 105 being identical. The head pad 106 is connected to the element substrate pad 107 of the black ink element substrate, and supply voltage used for the converted voltage generation circuits is applied thereto.

The voltage input from the element substrate pad 107 is respectively applied to the two function circuits 105 disposed on the black ink element substrate 101. Output from one of the function circuits 105 provided on the black ink element substrate 101 passes through a pad 107 on the black ink element substrate 101 and is input to a pad 107 on the color ink element substrate 102 adjacent to the black ink element substrate 101, which is connected to the pad 107. Moreover, output from the other function circuit 105 is input to arrays 103 on the black ink element substrate 101, which are made up heaters, their driving circuits, and control circuits. Moreover, output from the other function circuit 105 input to the color ink element substrate 102 is input to arrays 103 on the color ink element substrate 102, which are made up heaters, their driving circuits, and control circuits.

In accordance with the configuration of the present embodiment, heat generated as a result of power consumption in the function circuits 105 is produced only in the black ink element substrate 101. The black ink element substrate 101 is used mostly for text images and the size of the discharged droplets is larger than that of color inks. For this reason, the black ink element substrate 101 is not likely to be influenced by the ink discharge related effects of the heat generated in the element substrate as a result of power consumption by the function circuits 105. On the other hand, since there are no function circuits 105 on the color ink element substrate 102, the effects of the heat generated in the element substrate as a result of power consumption by the function circuits 105 are practically nonexistent. Moreover, operation based on the function circuits 105 of the black ink element substrate 101 is made possible and a high level of image printing can be achieved.

Furthermore, in the present embodiment, the function circuits 105 are aggregated on the black ink element substrate 101. In order to implement the desired functions, these function circuits 105 are sometimes required to have a BiCMOS structure with CMOS and bipolar transistors. In the past, the respective function circuits 105 were disposed separately on the black ink element substrate 101 and on the color ink element substrate 102. For this reason, BiCMOS structures were required for both element substrates. In the present embodiment, however, a BiCMOS structure is used only on the black ink element substrate 101 and a cheaper CMOS structure can be used on the color ink element substrate 102. For this reason, a reduction in the manufacturing cost of the printhead is made possible. However, this does not mean that one of the element substrates has to be manufactured using a BiCMOS process while the other has to be manufactured using a CMOS process. If necessary, both may be made by a CMOS process, or both by a BiCMOS process. Moreover, other processes may be used as well.

Moreover, although there are two function circuits 105 provided in FIG. 1, it is not implied that it is essential to provide exactly two. If a configuration is utilized, in which the functions of the black ink element substrate 101 and color ink element substrate 102 are satisfied with the help of a single function circuit 105, then just one function circuit can be used. Typically, when a single function circuit is used, in many cases the layout area occupied by the function circuit 105 on the black ink element substrate 101 can be reduced in comparison with cases, in which there are two individually provided circuits. For this reason, reducing the number of function circuits to just one is also appropriate from the standpoint of reducing the area of the element substrates. In particular, in comparison with cases, in which respective function circuits 105 are disposed on the black ink element substrate 101 and on the color ink element substrate 102, the required pads, control terminals, etc. can be aggregated on one of the element substrates, thereby permitting a considerable reduction in the area of the element substrates.

Figure 8:
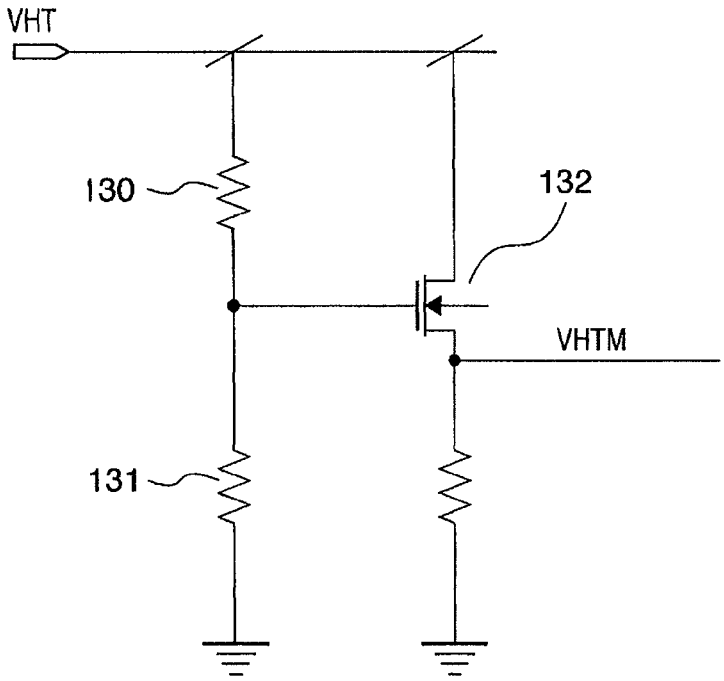
FIG. 8 PRIOR ART
FIG. 8 is a circuit diagram of a conventional converted voltage generation unit.
Figure 11:
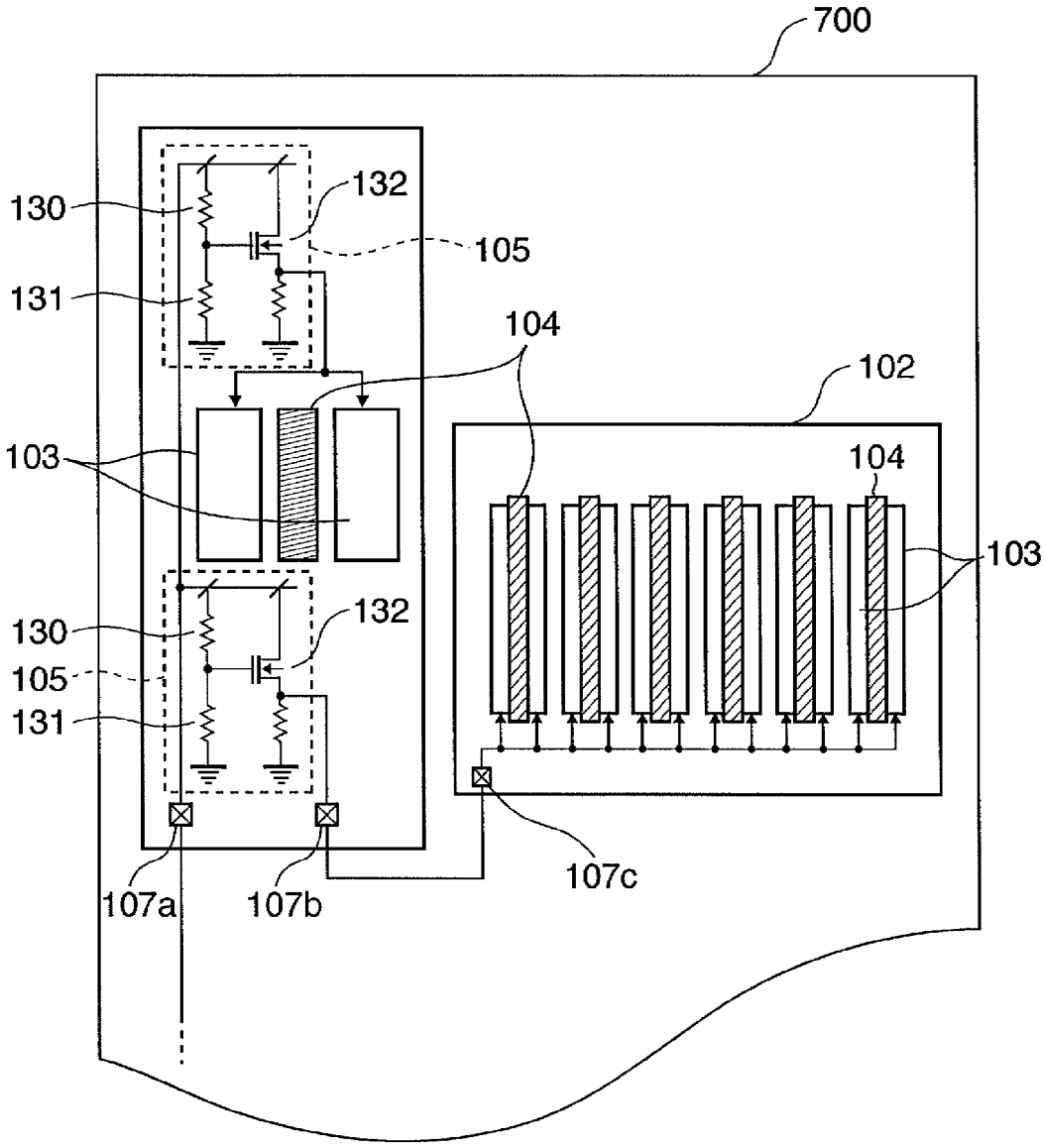
FIG. 11 is a block diagram illustrating the circuit configuration of the first embodiment.

As a more specific example, FIG. 11 shows a circuit diagram used in a case, wherein the converted voltage generation circuit of FIG. 8 is utilized as the function circuits 105 of the present embodiment.

The converted voltage generation circuit of FIG. 8 (converted voltage generation unit 125) is configured such that the driver driving voltage VHTM is output by a source follower circuit that applies the desired voltage, which is set depending on the resistance ratio of resistors 130 and 131, to the gate of a MOS transistor 132. The voltage value of the driver driving voltage VHTM is determined by the ratio of the resistance values of the resistors 130,131 and voltage VHT, which has the same potential as the heater supply voltage VH.

In the example depicted in FIG. 11, two converted voltage generation circuits similar to those of FIG. 8 are disposed on the black ink element substrate 101. It should be noted that the converted voltage generation circuits 105 are enclosed within broken lines.

The converted voltage generation circuits 105 perform step-down conversion on the supply voltage VHT, which is applied via the pad 107*a*, and output a driver driving voltage VHTM.

In order to drive the black ink element substrate, one output terminal used for the driver driving voltage VHTM of one of the two converted voltage generation circuits 105 is connected to the arrays 103, which are made up of heaters, their driving circuits, and control circuits. It should be noted that the arrays 103 are disposed in two locations side-by-side, sandwiching an ink supply port 104.

The other output terminal used for the driver driving voltage VHTM is connected to pad 107*b*, with the pad 107*b* connected to pad 107*c* on the color ink element substrate 102 via an external substrate 700. Inside the color ink element substrate 102, the pad 107*c* is connected to arrays 103 made up of heaters, their driving circuits, and control circuits inside the color ink element substrate, in such a manner that the driver driving voltage VHTM is used on the color ink element substrate.

Figure 6:
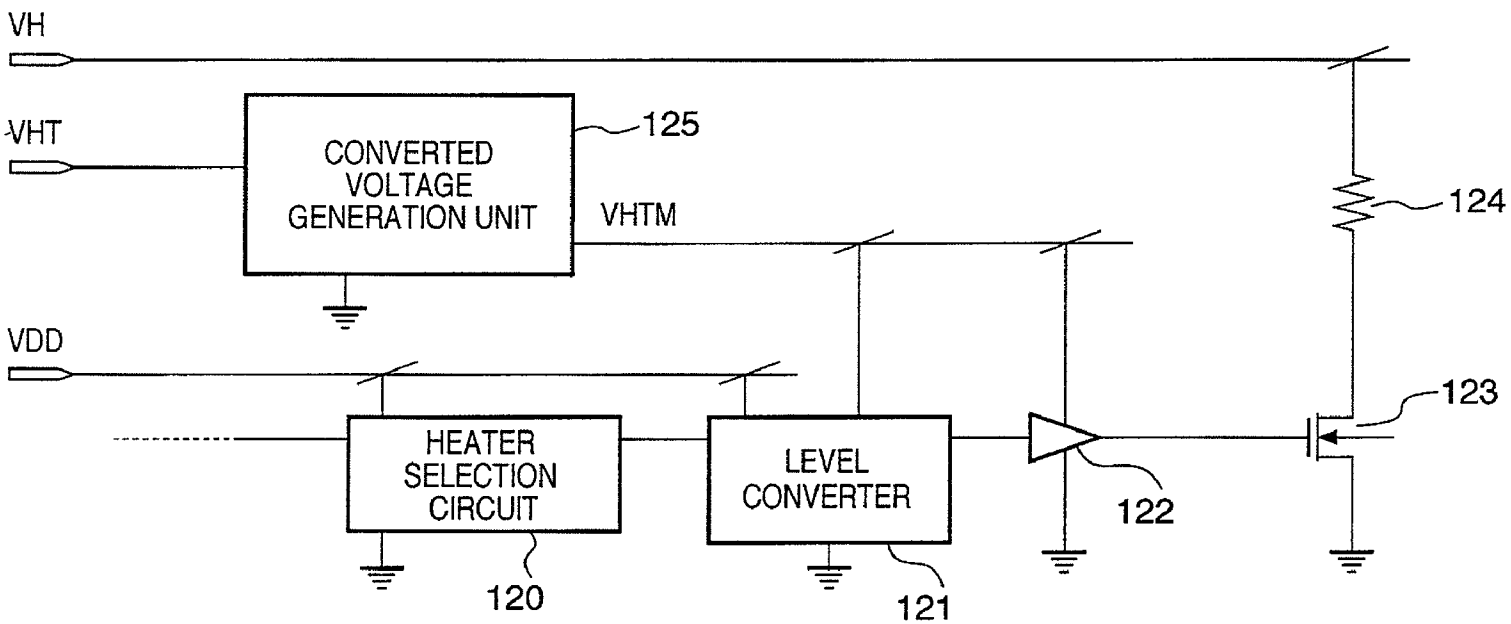
FIG. 6 PRIOR ART
FIG. 6 is a diagram illustrating an example of an equivalent circuit of a prior-art single segment comprising a heater, a driver transistor, etc.
Figure 7:
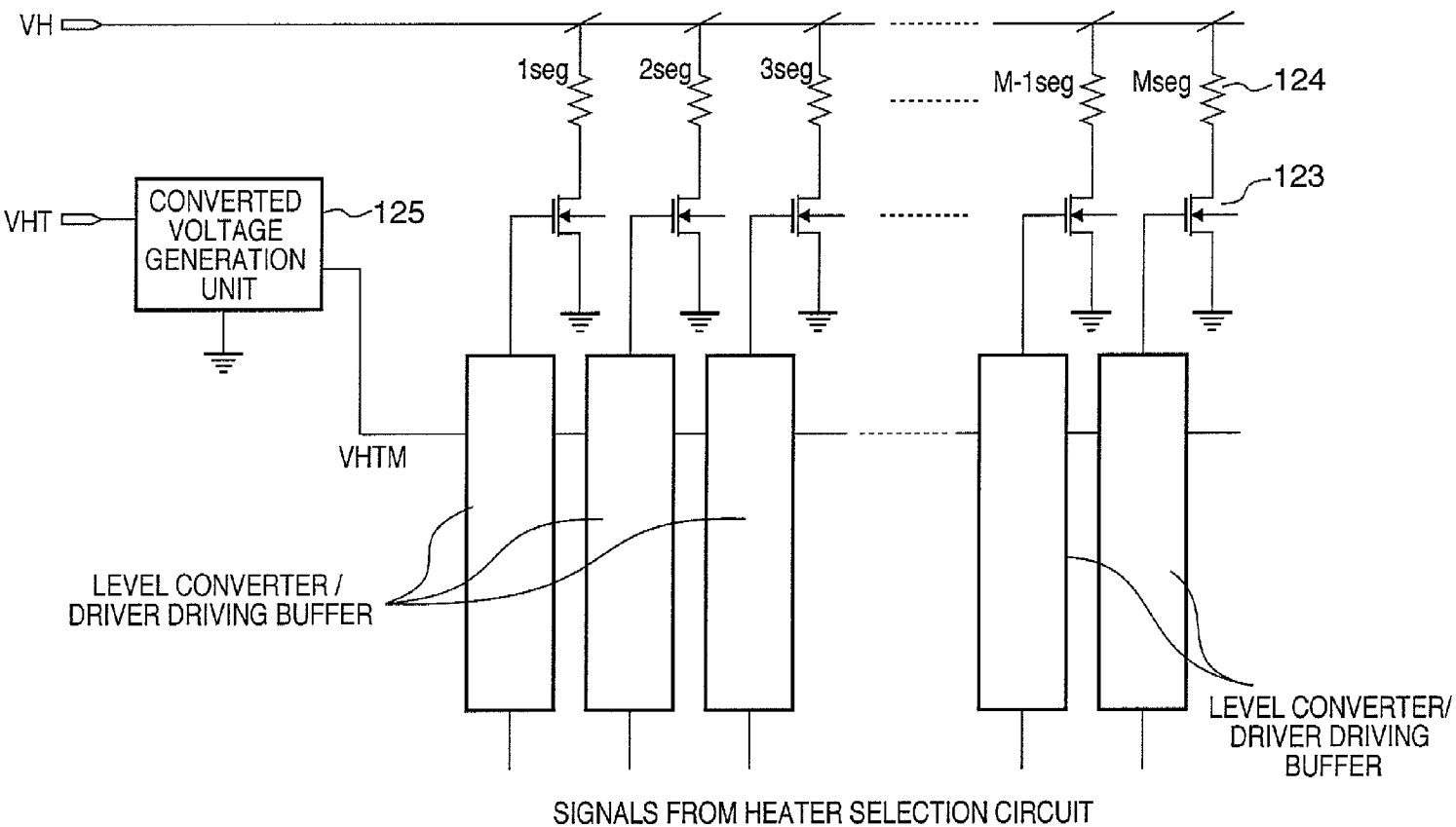
FIG. 7 is a diagram illustrating a relationship between a converted voltage generation unit and driving circuits used for multiple segments provided on an element substrate in a printhead.

Here, both the color and black element substrates have heaters, their driving circuits, and control circuits of the circuit configuration depicted in FIG. 7, and a single circuit segment has the configuration shown in FIG. 6.

Figure 12:
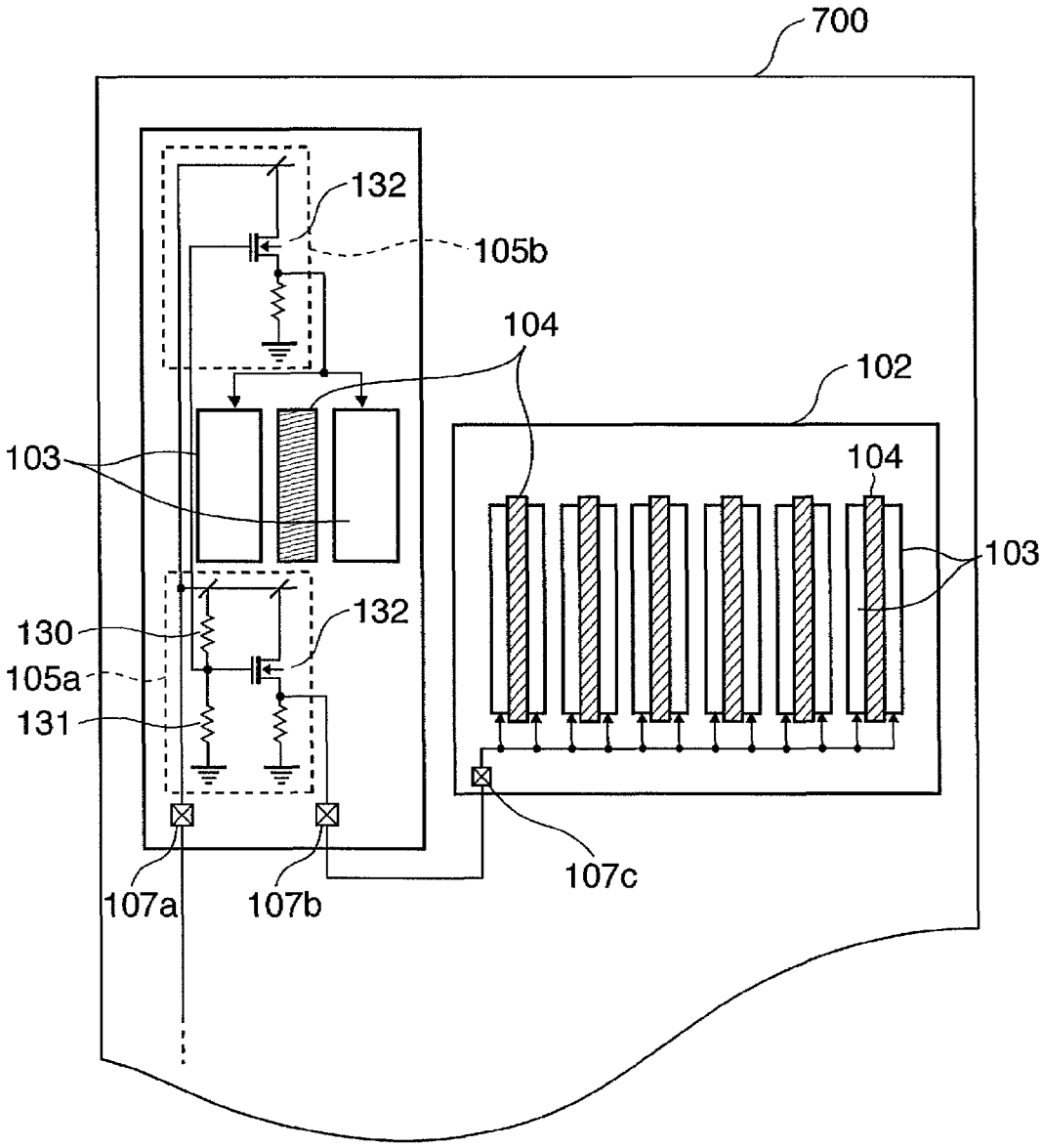
FIG. 12 is a block diagram illustrating the circuit configuration of the first embodiment.

Furthermore, restricting the number of the function circuits in the present embodiment to a single circuit produces the example shown in FIG. 12, which is appropriate from the standpoint of reducing the surface area of the element substrates.

In FIG. 12, the converted voltage generation circuits of the black ink element substrate and color ink element substrate, in the same manner as in FIG. 11, are aggregated on the black ink element substrate, but here the converted voltage generation circuit of the color ink element substrate is designated as 105*a* and the converted voltage generation circuit of the black ink element substrate is designated as 105*b*. The converted voltage generation circuit 105*a* is configured such that the driver driving voltage VHTM is output by a source follower circuit that applies the desired voltage, which is set depending on the resistance ratio of resistors 130 and 131, to the gate of a MOS transistor 132. On the other hand, the converted voltage generation circuit 105*b* is configured such that it does not contain the resistors 130 and 131 and the desired voltage set by the resistors 130 and 131 of the converted voltage generation circuit 105*a* is applied to the gate of the MOS transistor 132 of the converted voltage generation circuit 105*b*. By doing so, a reduction in the surface area of the element substrates is achieved. A considerable reduction in the surface area of the element substrates is afforded by sharing parts of the function circuits on the same element substrate.

However, the "function circuits", as defined in this invention, are of course not limited thereto. For instance, it can be a circuit performing the function of adjusting the heater current, a memory storing element substrate information and characteristics, a logical circuit processing print data, an analog circuit, etc. Moreover, it can be a circuit used for outputting signals indicating the status of the element substrates such as the temperature of the element substrates, or a circuit comprising an analog-to-digital converter etc., which accepts analog data as input, converts it to digital data, and outputs it. Furthermore, it may be a circuit used to change the status of the element substrates based on information from the main body of the printer apparatus, such as, for instance, a circuit used for controlling the temperature of the element substrates or a circuit comprising a digital-to-analog converter.

In addition, while the present embodiment shows an example, in which the function circuits that implement functions used by the black ink element substrate 101 and by the color ink element substrate 102 are installed on the black ink element substrate 101, the configuration is not limited thereto. For instance, a configuration is also possible, in which a function circuit 105 implementing some or all of the functions that are used by the color ink element substrate 102, but not by the black ink element substrate 101, is installed on the black ink element substrate 101 and its functions are used by the color ink element substrate.

The Second Embodiment

In the second embodiment, an example is shown wherein, on the one hand, a function circuit used by a color ink element substrate is installed on a black ink element substrate, and, on the other hand, a function circuit used by the black ink element substrate is installed on the color ink element substrate. Heat generated as a result of power consumption by the function circuits is distributed, and it is primarily the function circuit installed on the black ink element substrate that operates during the printing of photographs and other color images, during which discharge from the color ink element substrate takes center stage. On the other hand, it is primarily the function circuit installed on the color ink element substrate that operates during the printing of text and the like, when discharge from the black ink element substrate takes center stage. In this configuration, the focus is on the fact that the discharge operation, which is characteristic of an inkjet printing apparatus, is carried out mostly either by the color ink element substrate or by the black ink element substrate, with relatively few operations performed by the other element substrate.

In the present embodiment, the power consumption of the function circuit of the element substrate that primarily performs the discharge operation is suppressed and the function circuit of the other element substrate, which is mostly inactive in terms of discharge operations, is operated and its functionality is utilized. Undue temperature rise is mitigated by distributing heat generated by the heaters and heat produced by the function circuits and averaging the rise in the temperature of the element substrates. Moreover, in the present configuration, the function circuit used is the one belonging to the substrate whose heaters do not have much current flowing therethrough. For this reason, the effects of the current noise generated by the current flowing through the heaters on the function circuits can be suppressed and it becomes possible to raise the reliability of operation of the function circuits.

Figure 2:
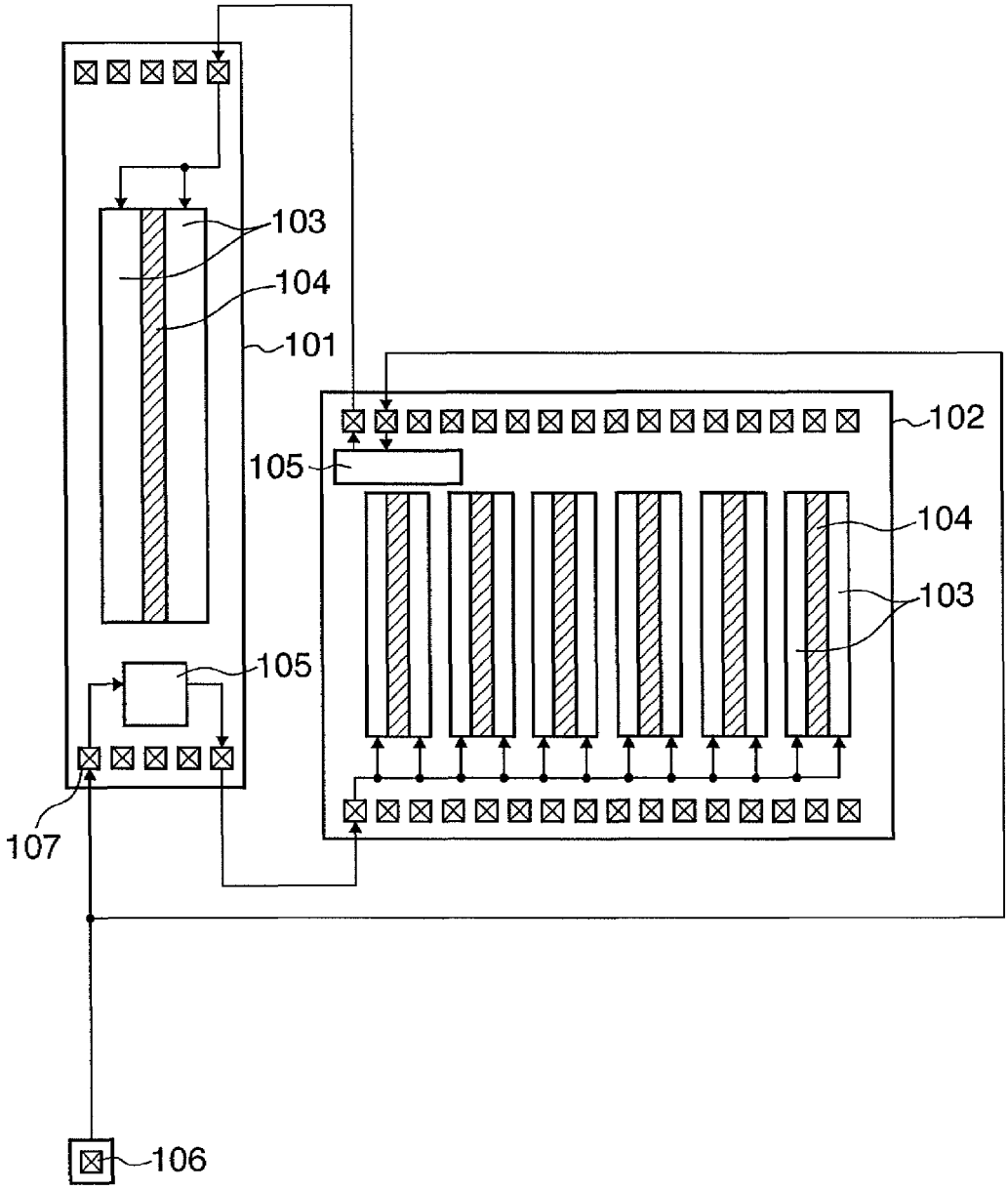
FIG. 2 is a block diagram illustrating the circuit configuration of the second embodiment.

FIG. 2 is a block diagram illustrating the circuit configuration of the second embodiment.

It should be noted that FIG. 2 makes use of the same constituent elements as the circuit blocks illustrated in FIG. 1 and, since the same reference numbers are used, the corresponding descriptions of the respective constituent elements are omitted.

In the second embodiment, on the one hand, a function circuit 105 used by a color ink element substrate 102 is installed on a black ink element substrate 101, and, on the other hand, a function circuit 105 used by the black ink element substrate 101 is installed on the color ink element substrate 102.

When the operation of the color ink element substrate 102 takes center stage, as it does during the printing of photographic images, etc., it is the function circuit 105 of the black ink element substrate 101 that is primarily operated. Since the color ink element substrate 102 has a high current flowing through the heaters when ink is discharged, heat is generated in the color ink element substrate 102 and, simultaneously, a lot of current noise is generated due to the current flowing through the heaters. On the other hand, the black ink element substrate 101 experiences relatively low heat generation due to the heaters and has little current noise due to the current flowing through the heaters when operation concentrates primarily in the color ink element substrate 102. The effects of the heat generated as a result of power consumption by the function circuit 105 on the color ink element substrate 102 are suppressed by operating the function circuit 105 installed on the black ink element substrate 101 and inputting its output to the color ink element substrate 102. Moreover, the effects of the current noise generated by the current flowing through the heaters of the color ink element substrate 102 on the operation of the function circuit 105 of the black ink element substrate 101 are also suppressed.

On the other hand, when the operation of the black ink element substrate 101 takes center stage, as it does during the printing of text, etc., conversely, it is the function circuit 105 of the color ink element substrate 102 that is operated, thereby enabling the same effects as above.

The function circuits 105 of the present embodiment are, specifically, converted voltage generation circuits such as the ones depicted in FIG. 8; however, in the same manner as in the first embodiment, other circuits can also be used.

Figure 13:
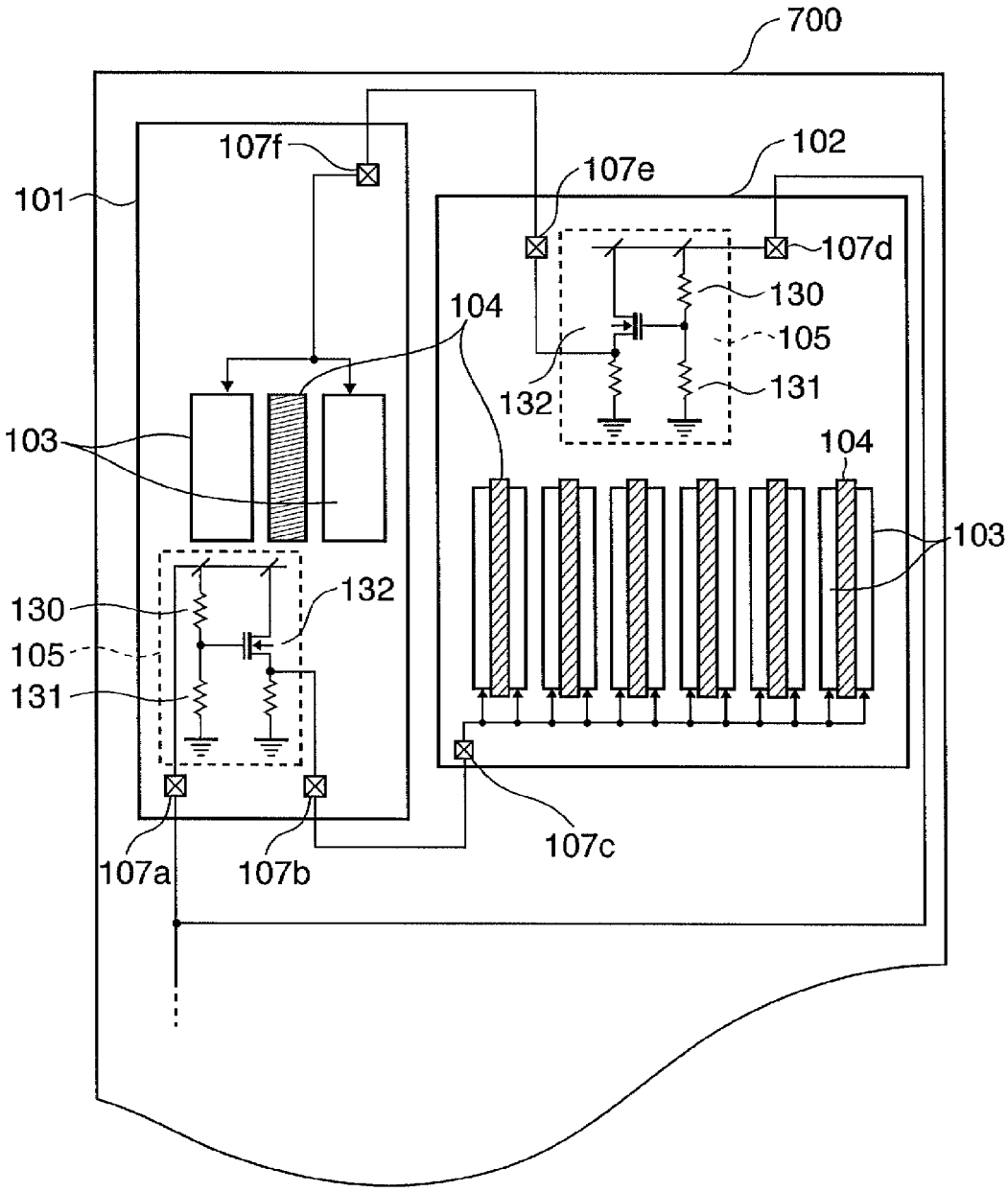
FIG. 13 is a block diagram illustrating the circuit configuration of the second embodiment.

FIG. 13 shows an example, in which converted voltage generation circuits such as the ones illustrated in FIG. 8 are used as the function circuits 105. The output of the function circuit 105 disposed on the black ink element substrate 101 is applied to the color ink element substrate 102. On the other hand, the output of the function circuit 105 disposed on the color ink element substrate 102 is applied to the black ink element substrate 101. When the operation of the color ink element substrate 102 takes center stage during the printing of photographs etc., arrays 103, which are made up of heaters located inside the color ink element substrate, their driving circuits, and control circuits, are actuated. At such time, the driver driving voltage VHTM is output from the converted voltage generation circuit 105 of the black ink element substrate. As a result of actuating the arrays 103, which are made up of heaters located inside the color ink element substrate, their driving circuits, and control circuits, the color ink element substrate experiences a temperature rise, but the circuit that generates the driver driving circuit VHTM is the converted voltage generation circuit 105 formed on the black ink element substrate, whose printing operation does not take center stage. For this reason, the rise in chip temperature associated with the printing operation is distributed between the color/black ink element substrates. Moreover, while noise is generated in the color ink element substrate by the flow of high electrical current through the heaters, it becomes possible to generate converted voltage using the black ink elements, in which the heater current is lower and the effects of the noise are smaller. This helps improve the operational reliability of the color ink element substrate.

The Third Embodiment

An example, in which the desired functionality is attained by installing function circuits on the black ink element substrate and on the color ink element substrate such that both function circuits are complementary, is shown in the third embodiment.

Figure 3:
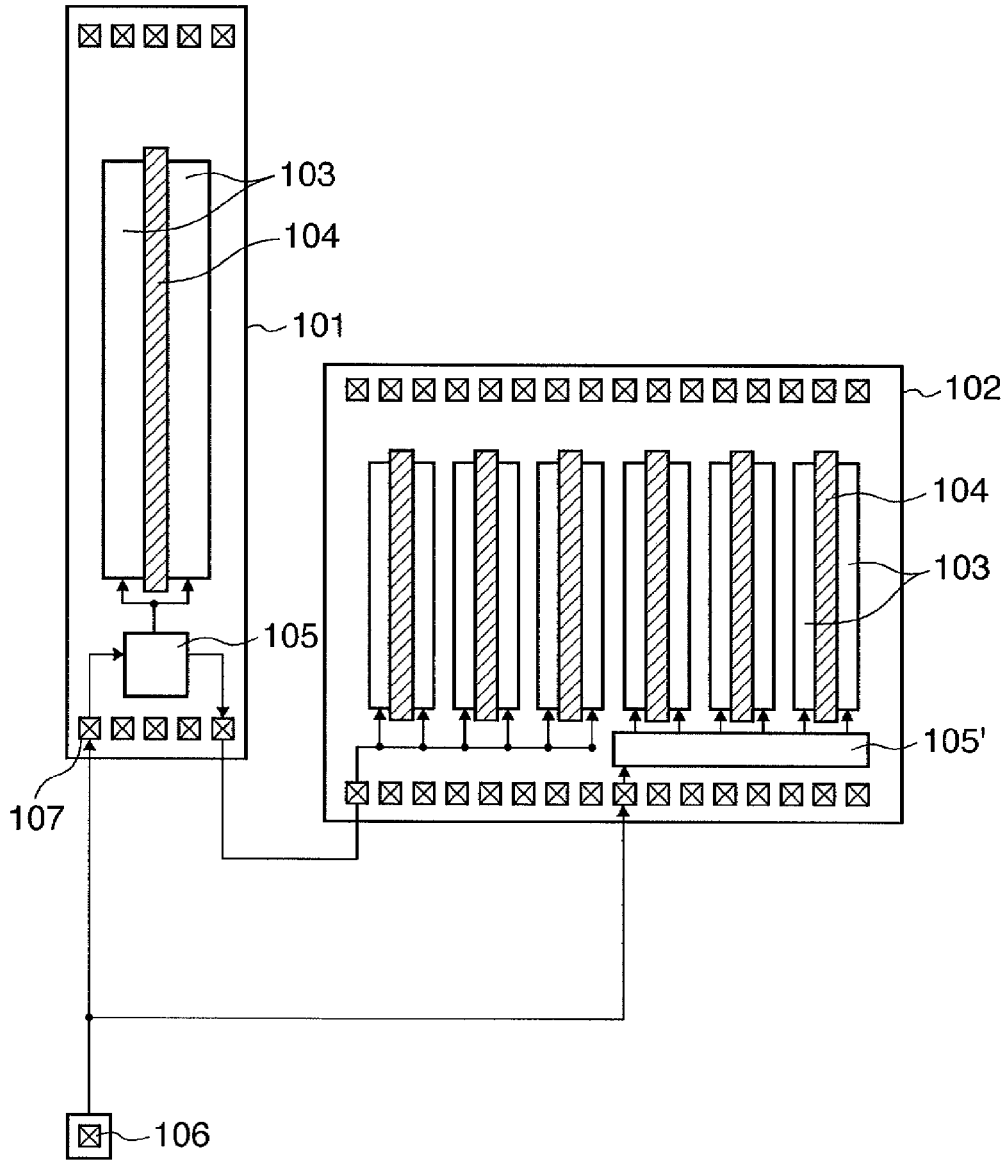
FIG. 3 is a block diagram illustrating the circuit configuration of the third embodiment.
Figure 4:
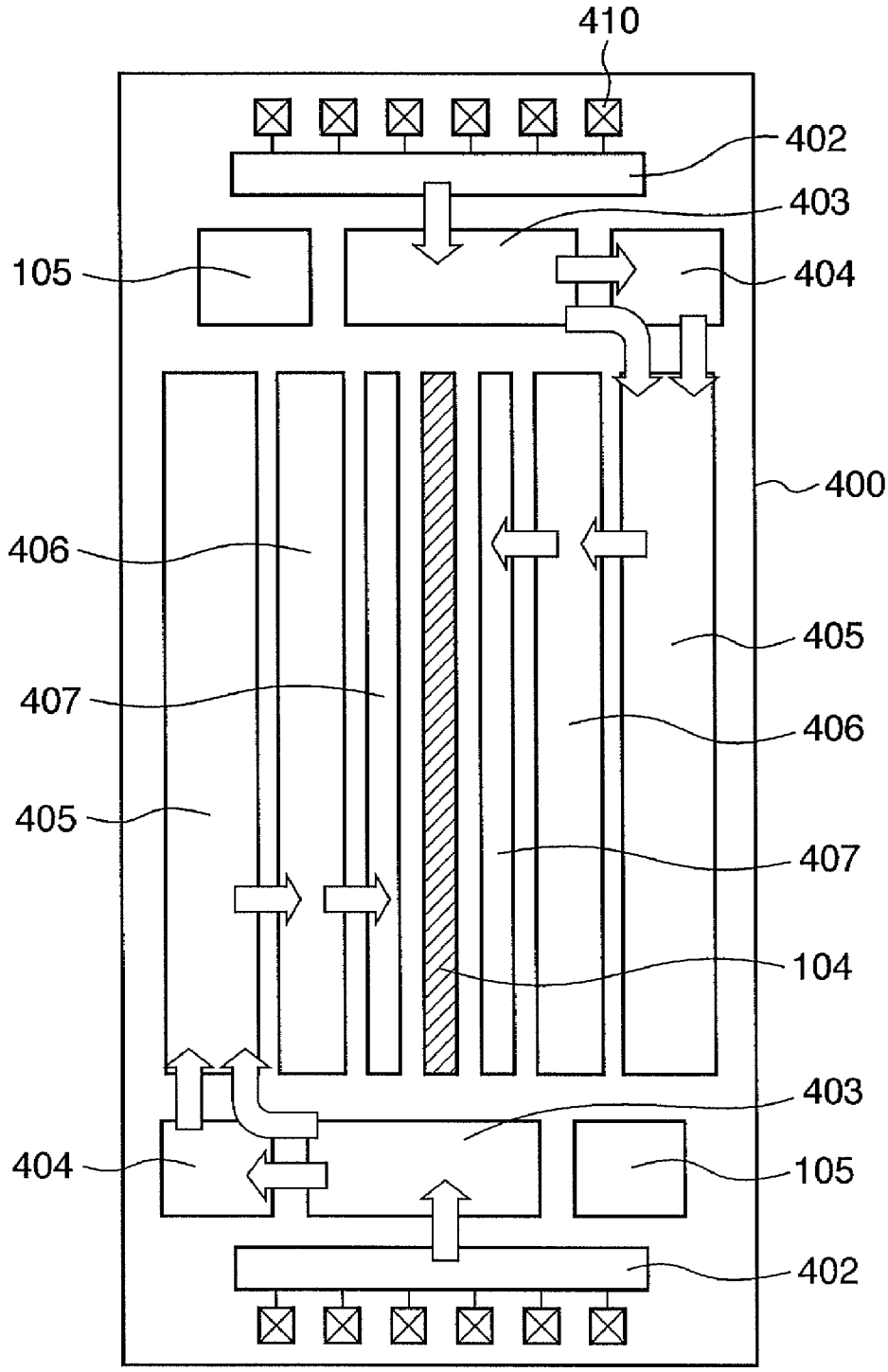
FIG. 4 is a diagram illustrating an example of circuit arrangement on an element substrate having heaters and driving circuits integrally formed thereon.

FIG. 3 is a block diagram illustrating the circuit configuration of the third embodiment.

It should be noted that FIG. 3 makes use of the same constituent elements as the circuit blocks illustrated in FIG. 1 and, since the same reference numbers are used, the corresponding descriptions of the respective constituent elements are omitted.

In the configuration of the present embodiment, the function circuit 105 formed on the black ink element substrate is shared between the black ink element substrate and a portion of the color ink element substrate. Moreover, the function circuit 105' formed on the color ink element substrate outputs signals to circuitry that does not accept as input the output of the function circuit 105 of the black ink element substrate (arrays 103 made up of heaters located inside the color ink element substrate, their driving circuits, and control circuits).

In the configuration of the present embodiment, a portion of the function circuit of the color ink element substrate, which tends to have a larger circuit scale in comparison with the black ink element substrate as a result of its multi-array configuration, is carried by the black ink element substrate, thereby preventing circuitry from disproportionate concentration on the color ink element substrate. The present configuration makes it possible to keep one of the chips on the color ink element substrate and black ink element substrate from unilaterally growing in size. Moreover, using a distributed circuit arrangement permits suppression of the disproportion in power consumption between the color ink element substrate and black ink element substrate. In other words, being able to distribute generated heat evenly across the surface area of the heat dissipation-capable element substrate also permits mitigation of the rise in element substrate temperature associated with power consumption by the function circuits 105 etc. and its effects on the discharging characteristics.

The function circuits 105 of the present embodiment are, specifically, the converted voltage generation circuits illustrated in FIG. 8; however, in the same manner as in the first embodiment or the second embodiment, other circuits can also be used.

Figure 14:
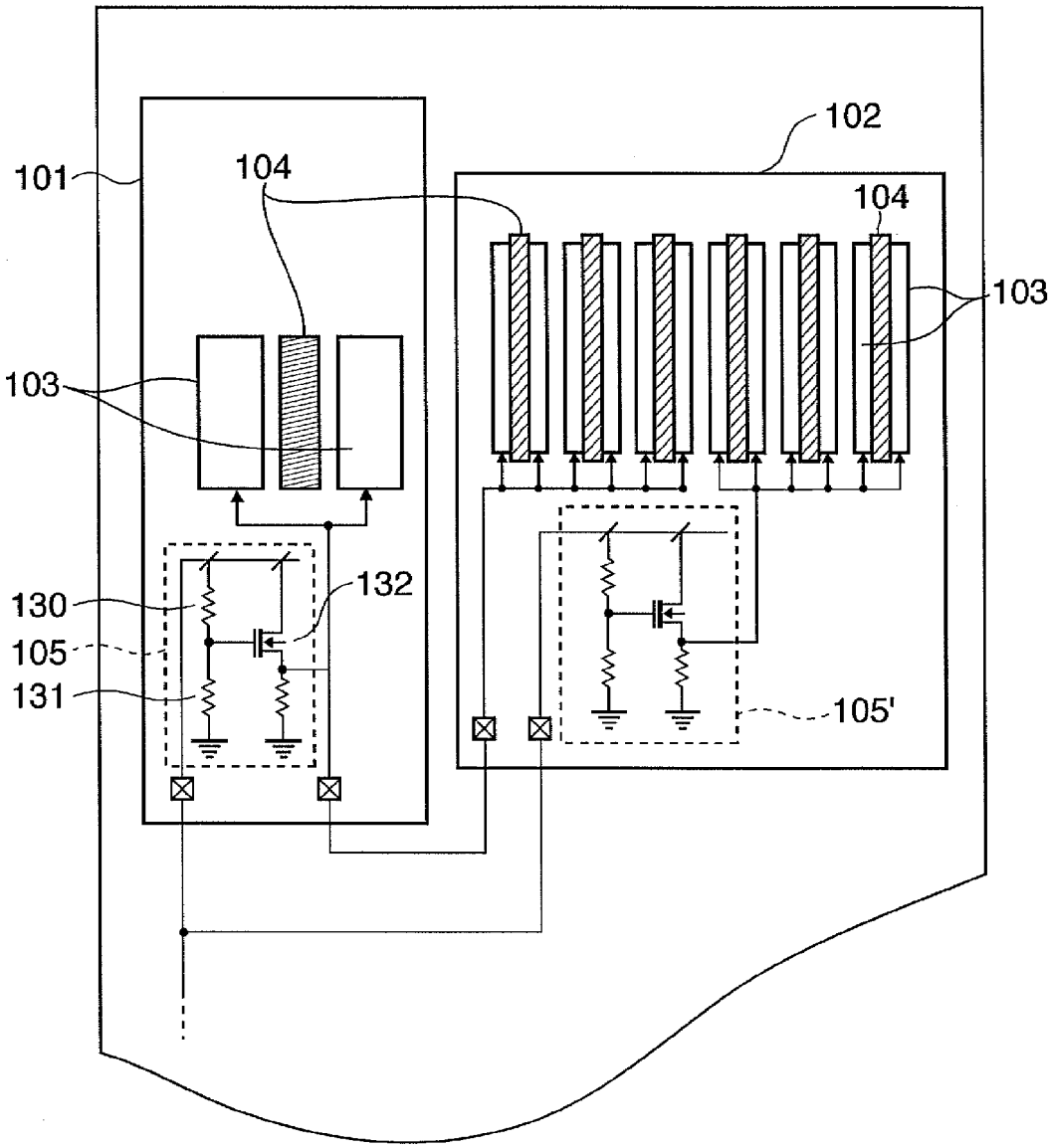
FIG. 14 is a block diagram illustrating the circuit configuration of the third embodiment.

FIG. 14 shows an example, in which converted voltage generation circuits such as the ones illustrated in FIG. 8 are used as the function circuits 105 and 105'. The output of the converted voltage generation circuit 105 disposed on the black ink element substrate 101 is applied to some of the circuits on the color ink element substrate 102 and the black ink element substrate. On the other hand, the output of the converted voltage generation circuit 105' disposed on the color ink element substrate 102 is applied to the remaining circuits that don't accept as input the output from the converted voltage generation circuit 105 on the black ink element substrate.

In comparison with the black ink element substrate, the color ink element substrate often has multiple circuits disposed thereon in accordance with the number of colors and tends to have a larger circuit scale. Along with imparting some of the functions of the converted voltage generation circuit driving these circuits to the black ink element substrate, which has a smaller circuit scale, the remainder of the function circuit is placed on the color ink element substrate in such a manner that circuitry is not disproportionately concentrated on one of the substrates.

Figure 15:
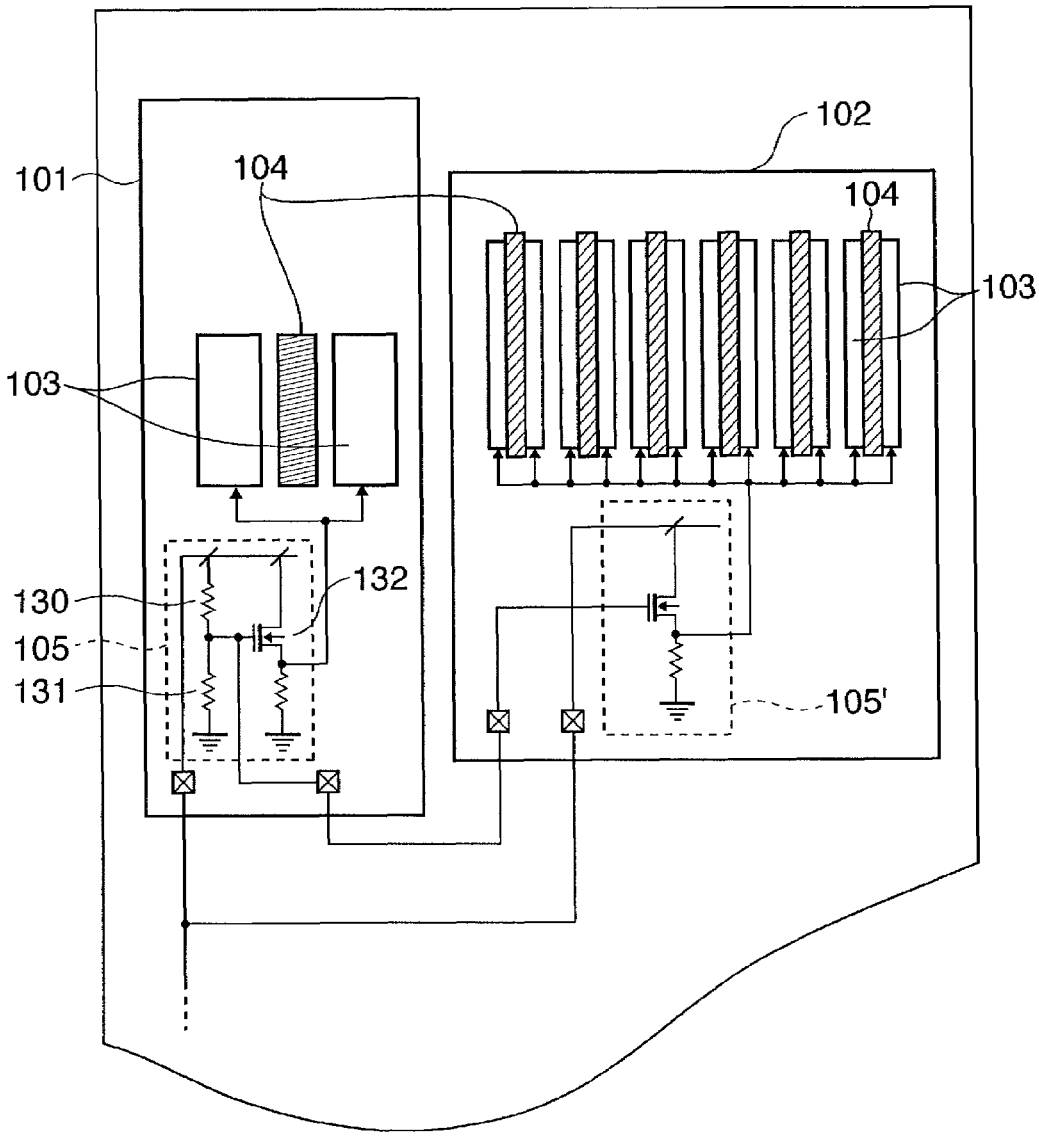
FIG. 15 is a block diagram illustrating the circuit configuration of the third embodiment.

In addition, another example is illustrated in FIG. 15. In FIG. 15, the resistors 130 and 131 are only provided in the function circuit 105 of the black ink element substrate. In this configuration, the driver driving voltage VHTM that they generate is applied to the gates of the respective MOS transistors 132 of the black ink element substrate and color ink element substrate.

The present embodiment permits attenuation of the set voltage-related effects of the power supply noise and the rise in element substrate temperature during the operation of the color ink element substrate 102, which has a relatively large circuit scale and a high electric current flowing therethrough.

Moreover, while some embodiments have been described above in connection with configurations involving a color ink element substrate and a black ink element substrate, the configurations of the present invention are not limited thereto.

For instance, in a printhead including multiple color ink element substrates or a printhead including multiple black ink element substrates, effects that cancel the influence of temperature and noise can be obtained by placing function circuits between these element substrates in a distributed fashion, in the same manner as in the present embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-335069, filed Dec. 12, 2006, which is hereby incorporated by reference herein in its entirety.

What is claimed is:

1. A printhead comprising a plurality of printing elements and provided with first and second element substrates having the plurality of printing elements in such a manner that the first element substrate and the second element substrate are spaced apart, wherein the first element substrate has a first function circuit electrically connected to the second element substrate and having processing functions used for driving the printing elements of the second element substrate, and a second function circuit having processing functions used for driving the printing elements of the first element substrate.

2. The printhead according to claim 1, wherein the printhead has the plurality of printing elements, to which a first voltage is applied, and driving elements driving the plurality of printing elements, and at least one of the first function circuit and the second function circuit is a voltage generation circuit generating a second voltage used for driving the driving elements based on a voltage of the same potential as the first voltage.

3. A printhead comprising a plurality of printing elements and provided with first and second element substrates having the plurality of printing elements in such a manner that the first element substrate and the second element substrate are spaced apart, wherein the first element substrate has a first function circuit electrically connected to the second element substrate and having processing functions used for driving the printing elements of the second element substrate, and wherein the second element substrate has a second function circuit having processing functions used for driving the printing elements of the first element substrate.

4. The printhead according to claim 3, wherein the printhead has the plurality of printing elements, to which a first voltage is applied, and driving elements driving the plurality of printing elements, and at least one of the first function circuit and the second function circuit is a voltage generation circuit generating a second voltage used for driving the driving elements based on a voltage of the same potential as the first voltage.

5. A printhead comprising a plurality of printing elements and provided with first and second element substrates having the plurality of printing elements in such a manner that the first element substrate and the second element substrate are spaced apart, wherein the first element substrate has a first function circuit electrically connected to the second element substrate and having processing functions used for driving the printing elements of the second element substrate, and wherein the second element substrate has a second function circuit complementing the processing functions of the first function circuit.

6. The printhead according to claim 5, wherein the printhead has the plurality of printing elements, to which a first voltage is applied, and driving elements driving the plurality of printing elements, and at least one of the first function circuit and the second function circuit is a voltage generation circuit generating a second voltage used for driving the driving elements based on a voltage of the same potential as the first voltage.

7. A head cartridge having an ink tank containing ink and a printhead comprising a plurality of printing elements and provided with first and second element substrates having the plurality of printing elements in such a manner that the first element substrate and the second element substrate are spaced apart, wherein the first element substrate has a first function circuit electrically connected to the second element substrate and having processing functions used for driving the printing elements of the second element substrate, and a second function circuit having processing functions used for driving the printing elements of the first element substrate.

8. A printing apparatus having a printhead comprising a the plurality of printing elements and provided with first and second element substrates having the plurality of printing elements in such a manner that the first element substrate and the second element substrate are spaced apart, wherein the first element substrate has a first function circuit electrically connected to the second element substrate and having processing functions used for driving the printing elements of the second element substrate, and a second function circuit having processing functions used for driving the printing elements of the first element substrate.

9. A head cartridge having an ink tank containing ink and a printhead comprising a plurality of printing elements and provided with first and second element substrates having the plurality of printing elements in such a manner that the first element substrate and second element substrate are spaced apart, wherein the first element substrate has a first function circuit electrically connected to the second element substrate and having processing functions used for driving the printing elements of the second element substrate, and wherein the second element substrate has a second function circuit having processing functions used for driving the printing elements of the first element substrate.

10. A printing apparatus having a printhead comprising a plurality of printing elements and provided with first and second element substrates having the plurality of printing elements in such a manner that the first element substrate and the second element substrate are spaced apart, wherein the first element substrate has a first function circuit electrically connected to the second element substrate and having processing functions used for driving the printing elements of the second element substrate, and wherein the second element substrate has a second function circuit having processing functions used for driving the printing elements of the first element substrate.

11. A head cartridge having an ink tank containing ink and a printhead comprising a plurality of printing elements and provided with first and second element substrates having the plurality of printing elements in such a manner that the first element substrate and the second element substrate are spaced apart, wherein the first element substrate has a first function circuit electrically connected to the second element substrate and having processing functions used for driving the printing elements of the second element substrate, and wherein the second element substrate has a second function circuit complementing the processing functions of the first function circuit.

12. A printing apparatus having a printhead comprising a plurality of printing elements and provided with first and second element substrates having the plurality of printing elements in such a manner that the first element substrate and the second element substrate are spaced apart, wherein the first element substrate has a first function circuit electrically connected to the second element substrate and having processing functions used for driving the printing elements of the second element substrate, and wherein the second element substrate has a second function circuit complementing the processing functions of the first function circuit.

* * * * *